United States Patent [19]

Clement

[11] Patent Number: 4,534,657

[45] Date of Patent: Aug. 13, 1985

[54] BLENDING AND EMULSIFYING APPARATUS

[75] Inventor: Maurice C. Clement, Cottage Grove, Wis.

[73] Assignee: Crepaco, Inc., Lake Mills, Wis.

[21] Appl. No.: 513,921

[22] Filed: Jul. 14, 1983

[51] Int. Cl.[3] ..... B01F 5/12

[52] U.S. Cl. ..... 366/265; 366/317; 366/328; 241/46.17

[58] Field of Search ..... 366/249, 316, 317, 328, 366/303, 262, 265; 241/46.11, 46.17

[56] References Cited

U.S. PATENT DOCUMENTS

| | | | |
|---|---|---|---|
| 1,406,791 | 2/1922 | Werner | 366/315 X |
| 1,582,518 | 4/1926 | Horrell | 366/317 |
| 2,230,146 | 1/1941 | Myers | 366/317 X |
| 2,464,588 | 3/1949 | Knudsen et al. | 366/317 X |
| 2,673,077 | 3/1954 | Messbauer | 366/343 X |
| 2,928,665 | 3/1960 | Epprecht | 366/264 X |
| 2,984,462 | 5/1961 | O'Connor | 366/316 |
| 3,044,750 | 7/1962 | Schmitt, Jr. | 366/316 X |
| 3,222,038 | 12/1965 | Ashcraft | 366/316 |
| 3,638,917 | 2/1972 | Osten | 366/316 X |
| 3,690,621 | 9/1972 | Tanaka et al. | 366/265 |
| 4,004,786 | 1/1977 | Stephens | 366/316 X |

FOREIGN PATENT DOCUMENTS

| | | | |
|---|---|---|---|
| 1442687 | 10/1969 | Fed. Rep. of Germany | 366/316 |
| 852149 | 1/1940 | France | 366/262 |
| 1204172 | 1/1960 | France | 366/316 |
| 259793 | 2/1949 | Switzerland | 366/316 |
| 912249 | 3/1982 | U.S.S.R. | 366/317 |

*Primary Examiner*—Philip R. Coe
*Assistant Examiner*—Frankie L. Stinson
*Attorney, Agent, or Firm*—Neuman, Williams, Anderson & Olson

[57] ABSTRACT

An apparatus is provided for blending and emulsifying a dry product with a viscous product, the latter being disposed to a predetermined level within a tank. The tank is provided with a dry product inlet disposed above the level of the viscous product. The apparatus includes a power actuated rotary agitator immersed within the viscous product and, when rotating at a predetermined speed, causes the viscous product to form a vortex into which the dry product is fed through the tank inlet. The agitator is provided with first and second disc members arranged in spaced, substantially parallel relation. One of the disc members is provided with an enlarged central opening. The disc members are interconnected to one another by a plurality of symmetrically arranged baffles. The periphery of at least one of the disc members is provided with a plurality of symmetrically arranged shear blades.

11 Claims, 14 Drawing Figures

FIG. 11
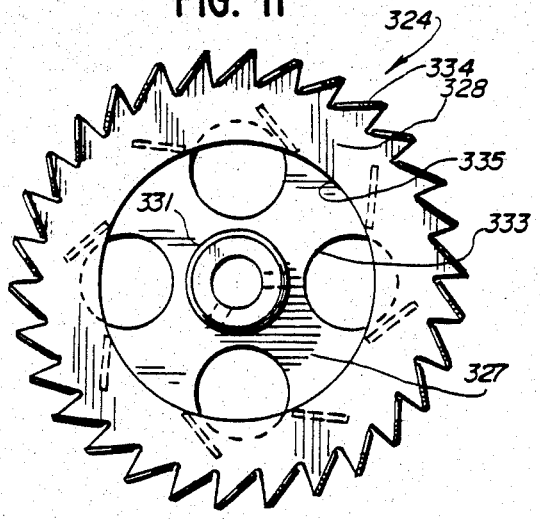
FIG. 9
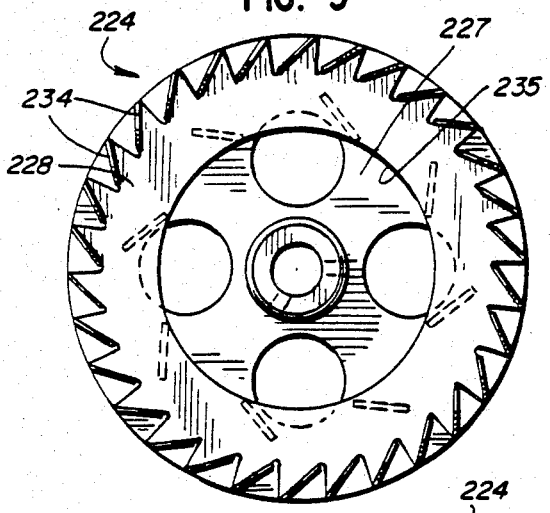
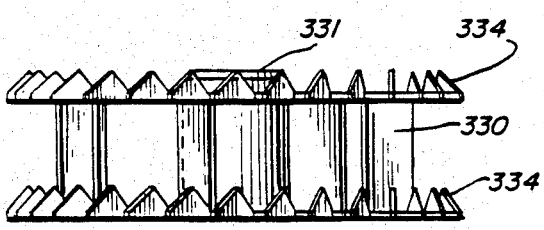
FIG. 12
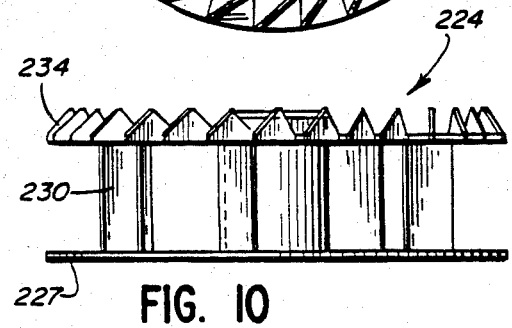
FIG. 10
FIG. 13
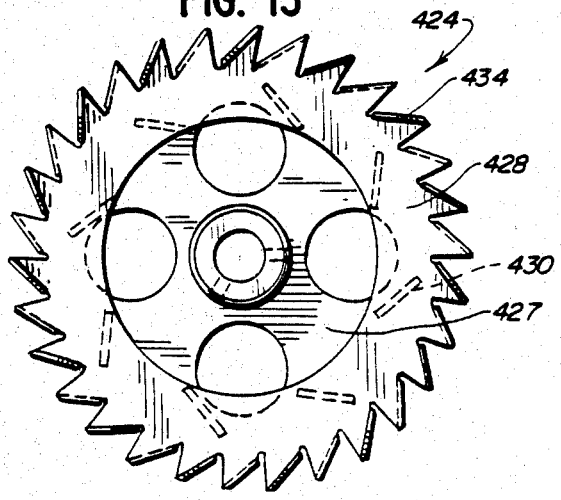
FIG. 7
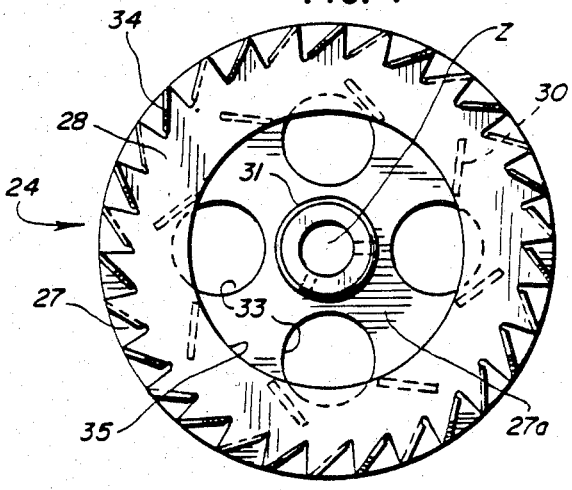
FIG. 14
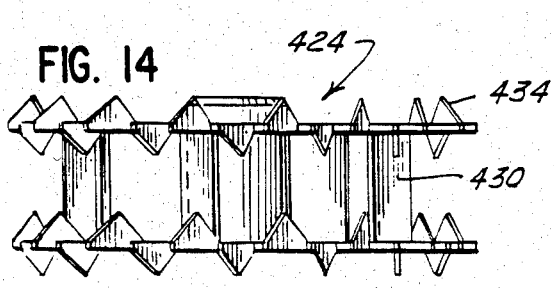
FIG. 8
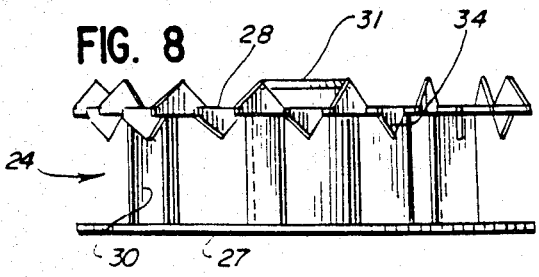

BLENDING AND EMULSIFYING APPARATUS

BACKGROUND OF THE INVENTION

Heretofore it has been common practice to perform blending and emulsifying of a dry product with a viscous product in two separate operations. Such a practice was undesirable for one or more of the following reasons: (a) it required additional costly equipment; (b) it was inefficient from the standpoints of time and energy usage; (c) it was difficult to monitor so as to obtain a mixture of uniform consistency; and (d) an inordinate amount of servicing and maintenance was required.

SUMMARY OF THE INVENTION

Thus, it is an object of the invention to provide a blending and emulisifying apparatus which readily overcomes the aforenoted shortcomings associated with prior apparatus of this general type.

It is a further object to provide a blending and emulsifying apparatus which is capable of accommodating a wide variety of products in either a cold or heated state.

It is a further object to provide a blending and emulsifying apparatus which is of simple, sturdy construction; is efficient in operation; and requires a minimal amount of servicing and maintenance.

It is a still further object to provide an apparatus of the type described wherein rapid incorporation of the dry product within the viscous product is attained with a substantially instant high shear action being exerted on the products to provide a resulting mixture of uniform consistency.

Further and additional objects will appear from the description, appended claims, and accompanying drawings.

In accordance with one embodiment of the invention, an apparatus is provided for blending and emulsifying a dry product with a viscous product. The viscous product is disposed within a tank to a predetermined level. The tank is provided with a dry product inlet which is located above the predetermined level of the viscous product. Disposed within the tank and immersed in the viscous product is a rotatable agitator which, when rotating at a predetermined speed, causes the viscous product to form a vortex. The dry product is fed into the vortex through the tank inlet. A drive means is provided for rotating the agitator at the predetermined speed. The agitator includes first and second disc members arranged in axially spaced relation. One of the disc members is provided with an enlarged central opening disposed in proximity to the bottom of the vortex. The disc members are interconnected to one another by a plurality of symmetrically arranged baffles. At least one of the disc members is provided with a plurality of symmetrically arranged peripheral shear blades which contact the dry and viscous products activated by the rotating agitator.

DESCRIPTION

For a more complete understanding of the invention, reference is made to the drawings wherein:

FIGS. 7 and 8 are top plan and side elevational views, respectively, of the agitator of FIG. 6.

FIGS. 9 and 10 are similar to FIGS. 7 and 8, respectively, but of a third form of the agitator per se.

FIGS. 11 and 12 are top plan and side elevational views, respectively, of a fourth form of the agitator per se.

FIGS. 13 and 14 are similar to FIGS. 11 and 12, respectively, but of a fifth form of the agitator per se.

Figure 1:
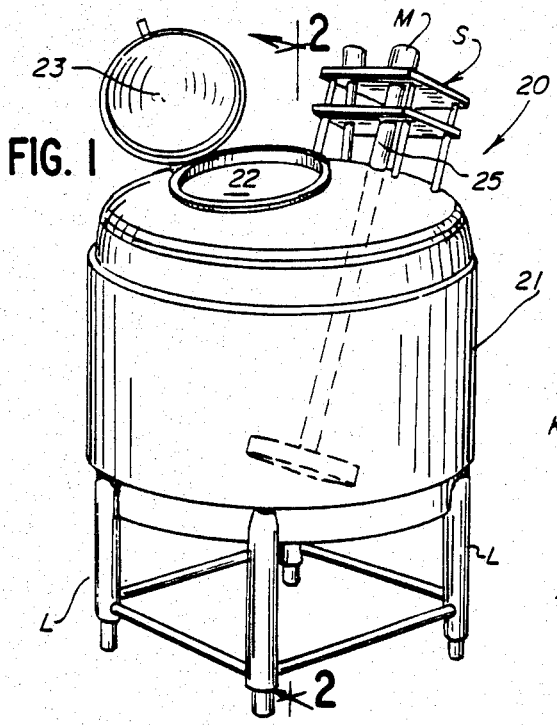
FIG. 1 is a fragmentary perspective view of one embodiment of the improved blending and emulsifying apparatus.
Figure 2:
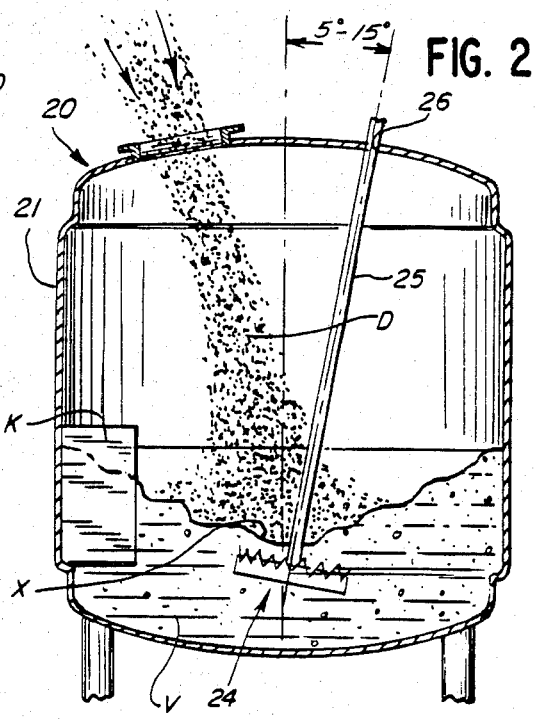
FIG. 2 is an enlarged fragmentary sectional view of the apparatus taken along section line 2—2 of FIG. 1 and showing in outline te vortex formed in the viscous product and the dry product being fed through the tank inlet into the vortex.
Figure 3:
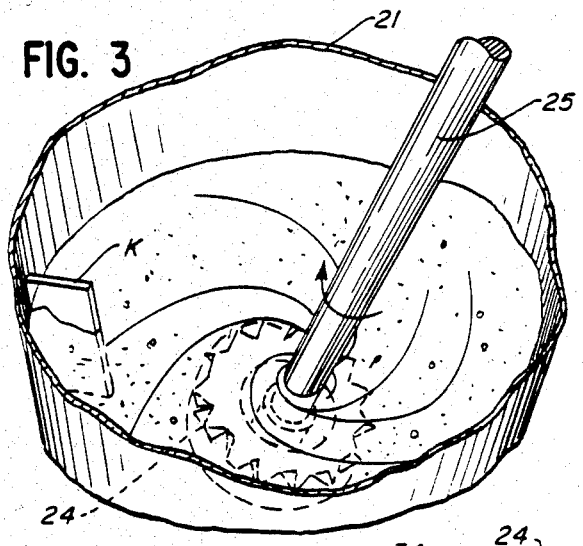
FIG. 3 is an enlarged fragmentary perspective view of the apparatus of FIG. 1 with the upper portion of the tank removed so as to reveal the vortex formed in the viscous product contained in the tank when the agitator is rotating at a predetermined speed.

Referring now to the drawings and more particularly to FIGS. 1–3, one embodiment of the improved apparatus 20 is shown which is suitable for use in batch producing dairy, food, or cosmetic products. The apparatus 20 includes a tank 21 preferably of stainless steel or like material, having a substantial capacity (e.g., 130 gallons). The size of the tank and the material of which it is formed will depend upon the amount and type of product being processed. The tank is preferably filled with a viscous product or ingredient so as not to exceed about 75% of the volume of the tank, thereby affording adequate free space within the tank for proper movement of the viscous and dry products therein when the apparatus is operating under normal conditions.

The viscous product may be pumped into the tank interior through suitable piping, not shown, disposed at either the bottom, top, or side of the tank. The blended and emulsified mixture of the dry and viscous products may be pumped out the tank through suitable piping, not shown, located at the bottom of the tank. The arrangement of the piping and pumps relative to the tank will depend upon the location of the tank within the processing plant.

The upper portion of the tank is provided an enlarged inlet opening 22 through which the dry product D is fed into the tank interior as will be described more fully hereinafter. A cover 23 is provided for closing off the inlet opening when desired. It is important that the inlet opening 22 be disposed above the level of the viscous product within the tank. In the illustrated embodiment the tank is free standing and is supported in an upright position by a plurality of symmetrically disposed depending legs L.

Mounted on the exterior of the upper portion of tank 21 is a support S on which is carried the drive motor M for an agitator 24. The horsepower rating of the motor is normally between 3 HP and 75 HP and the speed of rotation normally 600 RPM and above. The motor has a driveshaft 25 which extends downwardly therefrom through a suitable opening 26 formed in the upper portion of the tank, see FIG. 2. The driveshaft is preferably disposed at angle to the vertical of approximately 5°–15°. In some instances, however, it might be desirable for the shaft to rotate about a vertical axis or about an axis tilted at more than 15°.

Secured to the lower end of the shaft is the agitator 24. The agitator is normally positioned from the bottom of the tank, a distance of from 4" to 24" and will depend upon the desired depth of the vortex X formed in the viscous product when the agitator has attained its desired speed of rotation (e.g., 600 RPH). The relative location of the agitator within the tank interior and the desired speed of rotation will depend upon the viscosity of the viscous product and the type of the dry product to be fed into the tank interior.

Figure 6:
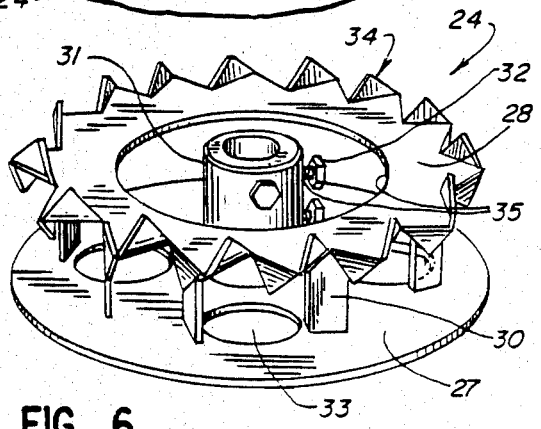
FIG. 6 is an enlarged perspective view of a second form of the agitator per se.

The form of the agitator 24 will also depend upon the products to be blended and emulsified. The agitator illustrated in FIGS. 2 and 3 as being disposed within the tank interior is shown per se in FIGS. 6–8. Agitator 24 includes a pair of disc members 27, 28 which are arranged in spaced, substantially parallel, superposed relation. The members 27, 28 are maintained in proper relative positions by a plurality of baffles 30 arranged symmetrically about the axis of rotation Z of the agitator. The corresponding ends of the baffles are fixedly secured by welding or the like to the opposed surfaces of the members. The baffles are preferably arranged on a common radius with respect to the axis Z.

Disc member 27 which is normally disposed closest to the bottom of the tank is provided with a centrally disposed hub 31 which is sized to accommodate the lower end portion of driveshaft 25. The hub may be provided with suitable locking screws 32 which are adjusted so as to lock the agitator to the shaft. Once the agitator has been locked in place on the shaft end portion, it may be welded to the shaft if desired.

To reduce the weight of the agitator as well as to effect more desirable flow patterns for the products within the tank interior, disc member 27 is provided with a plurality of symmetrically arranged apertures 33. As noted in FIG. 7, the apertures are primarily located within the area 27*a* disposed between the hub 31 and the ends of the baffles 30. The size, shape, and number of apertures 33 may vary from that shown without departing from the scope of the invention.

The baffles 30 are angularly disposed relative to the direction of rotation and effect outward discharge flow of the mixture of the viscous and dry products into the vicinity of the shear blades 34 formed on periphery of one or both of the disc members 27, 28. In the agitator 24 shown in FIGS. 6–8, the blades or teeth 34 are formed only on plate 28. Blades 34 alternately extend in opposite directions but also in a direction substantially parallel to the axis of rotation Z of the agitator. The blades are symmetrically arranged about the periphery of the disc member 28.

Centrally disposed in disc member 28 is an enlarged opening 35. The opening is disposed adjacent the bottom of the vortex X and it is down through the opening 35 that the mixture of the viscous and dry products flow, then outwardly between the baffles 30 and past the blades 34. There is also some flow of the mixture through the openings 33 formed in disc member 27 and thus, prevents the mixture disposed between the bottom of the tank and the disc member 27 from assuming a substantially quiescent state. Furthermore, the openings in both disc members reduce significantly the total weight of the agitator.

Variations in the configuration of the agitator are shown in FIGS. 4–5, 9–10, 11–12, and 13–14. The corresponding segments of the various agitators with respect to agitator 24 will be given the same identifying numbers except in the 100, 200, 300, and 400 series, respectively.

Figure 4:
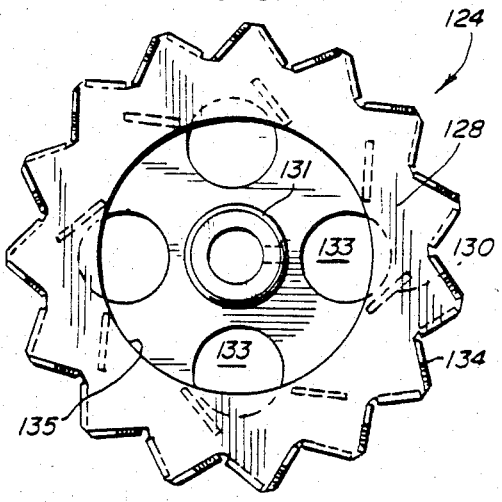
FIG. 4 is a top plan view of one form of the agitator per se.
Figure 5:
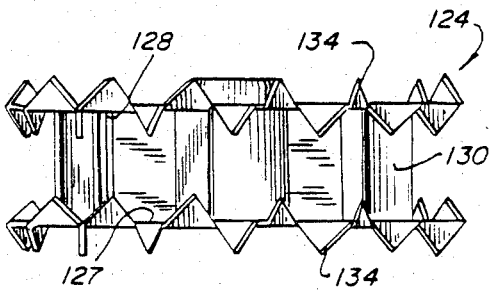
FIG. 5 is a side elevational view of the agitator of FIG. 4.

In FIGS. 4–5, the agitator 124 is provided with a plurality of symmetrically arranged shear blades 134 which are formed on the periphery of both disc members 127, 128. With both disc members 127, 128, alternate blades extend in opposite directions similar to that of the blades 34 in agitator 24. A further difference between agitators 24 and 124 is that in agitator 124 the number of blades formed on the periphery of either disc member 127, 128 is substantially less than the number of blades formed on member 28 of agitator 24. Aside from the aforementioned structural differences, agitators 24, 124 are basically the same.

Agitator 224, shown in FIGS. 9, 10 is very similar in structure to agitator 24, except that the shear blades 234 formed on disc member 228, all extend in substantially the same direction—that is to say, away from disc member 227, but in a direction substantially parallel to the rotary axis Z of the agitator.

Agitator 324, shown in FIGS. 11, 12, is substantially the same as agitator 224 except that both disc members 327, 328 have a like number of shear blades 334 formed on the peripheries thereof. The number of shear blades formed on the periphery of each disc member 327, 328 is substantially the same as the number of blades formed on the disc members 228, 28.

Agitator 424 illustrated in FIGS. 13, 14 is substantially the same as agitator 24 (FIGS. 6–8) except that both disc members 427, 428 have a like number of shear blades formed on each disc member extending in opposite directions from the disc member.

The particular configuration of the agitator will depend on various factors such as: the viscosity of the product V; the physical characteristics of the dry product; the temperatures of the products during the blending and emulsifying operations; and the relative volumes of the products involved.

While the apparatus herein described and illustrated utilizes a single agitator, there may be instances wherein two or more agitators are mounted on a single driveshaft. In other instances where a large volume tank is involved, two or more agitators mounted on a plurality of driveshafts may be used.

Thus, it has been found that by having the baffles and shear blades in close proximity to each other and to the bottom of the vortex into which the dry product is fed, rapid and more efficient blending and emulsifying of the products occurs. While product D has heretofore been referred to as a dry product, it is to be understood that the apparatus is not intended to be limited thereto. Thus, product D, if desired, may be another viscous product which is to be blended and emulsified with product V.

It will be noted in FIGS. 2 and 3 that the interior of the tank 21 may be provided with a stationary baffle K which protrudes inwardly towards the rotary axis of the agitator. The baffle K is optional and may be helpful in attaining the desired blending and emulsifying of certain types of products.

Thus, an improved apparatus 20 has been provided which is of simple, yet sturdy construction; is capable of accommodating a variety of products; and may be readily cleaned when required. The agitator utilized in the improved apparatus is compact and is radially balanced, thereby eliminating wobble and prolonging the wear-life of the motor bearings and the like. The structure of the agitator is such that it is capable of withstanding high head and torque pressures and forces.

I claim:

1. An apparatus for blending and emulsifying a shearable first product with a viscous second product disposed within a tank to a predetermined level, the tank being provided with a first product inlet disposed above the level of the second product, said apparatus comprising a rotatably mounted agitator immersible within the second product, said agitator, when rotating at a predetermined speed, causing the second product to form a vortex into which the first product is deposited through the tank inlet; and drive means connected to said agitator and effecting rotation thereof at said predetermined speed; said agitator including a first disc member having means for connecting to said drive means, said first disc member being proximate the bottom of the tank, a second disc member axially spaced from said first disc member and provided with an enlarged central opening, a plurality of symmetrically arranged, annularly spaced baffles interconnecting said first and second disc members, each baffle being angularly disposed relative to the direction of rotation of said agitator for imparting a pumping and blending action to the first and second products causing portions of same to flow outwardly between the baffles towards the periphery of said disc members, and a plurality of symmetrically arranged shear blades provided on a periphery of at least one disc member, said shear blades being disposed at a greater radial distance from the axis rotation than said baffles and extending into the flow path of the pumped portions of the first and second products and effecting shearing of the first product entrained in the pumped portions.

2. The apparatus of claim 1 wherein the shear blades are integral with and are formed on a periphery of at least the second disc member and extend transversely therefrom.

3. The apparatus of claim 1 wherein the shear blades extend in a direction substantially parallel to the axis of rotation of said agitator.

4. The apparatus of claim 1 wherein the shear blades extend in opposite directions substantially parallel to the axis of rotation of said agitator.

5. The apparatus of claim 1 wherein the shear blades are angularly disposed relative to the direction of rotation of said agitator.

6. The apparatus of claim 1 wherein the number of shear blades is greater than the number of baffles.

7. The apparatus of claim 1 wherein the first and second disc members are disposed in substantially parallel relation and substantially perpendicular to the axis of rotation.

8. An apparatus for blending and emulsifying a shearable product with a viscous product, said apparatus comprising a tank in which a predetermined amount of the viscous product is adapted to be disposed, said tank being provided with a shearable product inlet, the latter being above the level of the predetermined amount of viscous product within the tank; a rotatably mounted agitator disposed within the tank and immersed within the viscous product and positioned in proximity to the bottom of the tank, said agitator when rotating at a predetermined speed causing the viscous product to form a vortex into which the shearable product is deposited through the tank inlet; and a drive means connected to said agitator and effecting rotation thereof at said predetermined speed; said agitator including a first disc member having means for connecting to said drive means, a second disc member disposed in axially spaced substantially parallel coincident relation with respect to said first disc member, said second disc member being provided with an enlarged central opening substantially concentric with the axis of rotation and disposed in close proximity to the base of the vortex where said agitator is rotating at said predetermined speed, a plurality of symmetrically arranged annularly spaced baffles interconnecting said first and second disc members, said baffles being angularly disposed relative to the direction of rotation of said agitator and effecting substantial pumping and blending of portions of the viscous and shearable products outwardly between the disc members and between said baffles, and a plurality of symmetrically arranged shear blades provided on at least one of the disc members, each blade being disposed at a greater radial distance from the axis of rotation than any of said baffles and extending into the flow path of the pumped portions of the viscous and shearable portions.

9. The apparatus of claim 8 wherein the interior of said tank is provided with a stationary baffle spaced from said agitator and having at least a portion thereof immersed in the predetermined amount of the viscous product.

10. The apparatus of claims 1 and 8 wherein the first disc member is apertured.

11. The apparatus of claims 1 and 8 wherein the plurality of baffles are arranged at a common radius from the axis of rotation.

* * * * *

UNITED STATES PATENT AND TRADEMARK OFFICE

CERTIFICATE OF CORRECTION

PATENT NO. : 4,534,657

DATED : August 13, 1985

INVENTOR(S) : Maurice C. Clement

It is certified that error appears in the above-identified patent and that said Letters Patent is hereby corrected as shown below:

Column 1, line 68 "te" should be --the--.

Column 4, line 32, before "each" should be inserted --the peripheries thereof and with alternate blades on--.

Signed and Sealed this

*Twenty-eighth* Day of *January 1986*

[SEAL]

*Attest:*

DONALD J. QUIGG

*Attesting Officer*

*Commissioner of Patents and Trademarks*